US009938605B1

(12) United States Patent
Yurko

(10) Patent No.: US 9,938,605 B1
(45) Date of Patent: Apr. 10, 2018

(54) METHODS FOR MAKING ZIRCONIUM BASED ALLOYS AND BULK METALLIC GLASSES

(71) Applicant: Materion Corporation, Mayfield Heights, OH (US)

(72) Inventor: James A. Yurko, Saratoga, CA (US)

(73) Assignee: Materion Corporation, Mayfield Heights, OH (US)

( * ) Notice: Subject to any disclaimer, the term of this patent is extended or adjusted under 35 U.S.C. 154(b) by 230 days.

(21) Appl. No.: 14/872,425

(22) Filed: Oct. 1, 2015

Related U.S. Application Data

(60) Provisional application No. 62/058,648, filed on Oct. 1, 2014.

(51) Int. Cl.
*C22C 1/02* (2006.01)
*C22C 16/00* (2006.01)
(Continued)

(52) U.S. Cl.
CPC ..... *C22C 1/02* (2013.01); *C22B 4/005* (2013.01); *C22B 4/06* (2013.01); *C22C 1/002* (2013.01); *C22C 16/00* (2013.01); *C22C 45/10* (2013.01)

(58) Field of Classification Search
CPC ..... C22C 1/02; C22C 1/002; C22C 16/00; C22C 45/10; C22B 4/005; C22B 4/06
See application file for complete search history.

(56) References Cited

U.S. PATENT DOCUMENTS 3,880,652 A 4/1975 Wehn et al.
4,242,136 A 12/1980 Ishizuka
(Continued)

FOREIGN PATENT DOCUMENTS

EP 0248397 A2 12/1987
EP 1743949 A1 1/2007
WO 2011159596 A1 12/2011

OTHER PUBLICATIONS

Farrell, Raymond F., G. Jane Harter, and Ralph M. Jacobs. "Determination of Trace Inpurities in Zirconium Metal by Point-to-Plane Spectrochemical Procedure." ACS Publications. Westinghouse Electric Corporation, Jun. 1958. Web. Jul. 13, 2017.*
(Continued)

*Primary Examiner* — George Wyszomierski
*Assistant Examiner* — Tima M McGuthry Banks
(74) *Attorney, Agent, or Firm* — Jones Day

(57) ABSTRACT

Methods of preparing Zr based metallic using Zr sponge refined by a refining process are described. An exemplary method includes heating Zr sponge in a processing chamber with an electron-beam-heating apparatus or an arc-melting apparatus under a desired pressure condition to release volatile contaminants from the Zr sponge, introducing a purge gas into the processing chamber and permitting the purge gas to intermingle with at least some of the released volatile contaminants, evacuating the processing chamber to extract at least some of the purge gas and released volatile contaminants, repeating the heating of the Zr sponge, the introducing of the purge gas, and the evacuating of the processing chamber release and evacuate additional volatile contaminants from the Zr sponge to provide a processed Zr sponge with enhanced purity, and melting the processed Zr sponge with multiple other alloy constituents to provide a Zr-based metallic alloy.

23 Claims, 5 Drawing Sheets

(51) Int. Cl.

| | |
|---|---|
| ***C22C 45/10*** | (2006.01) |
| ***C22B 4/00*** | (2006.01) |
| ***C22C 1/00*** | (2006.01) |
| ***C22B 4/06*** | (2006.01) |

(56) References Cited

U.S. PATENT DOCUMENTS

| | | | | |
|---|---|---|---|---|
| 4,711,664 | A | | 12/1987 | Kwon et al. |
| 4,816,214 | A | * | 3/1989 | Worcester ..... C22B 9/228 376/261 |
| 4,823,358 | A | * | 4/1989 | Aguirre ..... H01J 37/305 164/506 |
| 4,849,013 | A | * | 7/1989 | Worcester ..... C22B 9/20 75/10.1 |
| 5,032,196 | A | | 7/1991 | Masumoto et al. |
| 5,078,789 | A | | 1/1992 | Abodishish et al. |
| 5,100,465 | A | | 3/1992 | Abodishish et al. |
| 5,288,344 | A | | 2/1994 | Peker et al. |
| 5,308,378 | A | | 5/1994 | Evans et al. |
| 5,735,975 | A | | 4/1998 | Lin et al. |
| 6,004,368 | A | | 12/1999 | Chandley et al. |
| 6,231,697 | B1 | | 5/2001 | Inoue et al. |
| 6,521,058 | B1 | | 2/2003 | Inoue et al. |
| 6,592,689 | B2 | | 7/2003 | Hays |
| 6,682,611 | B2 | | 1/2004 | Zhang et al. |
| 6,692,590 | B2 | | 2/2004 | Xing et al. |
| 6,805,758 | B2 | | 10/2004 | Wolter |
| 6,896,750 | B2 | | 5/2005 | Wolter |
| 7,008,490 | B2 | | 3/2006 | Peker |
| 7,070,665 | B2 | | 7/2006 | Hays |
| 7,153,376 | B2 | | 12/2006 | Wolter |
| 7,300,529 | B2 | | 11/2007 | Kuehn et al. |
| 7,368,023 | B2 | | 5/2008 | Chang et al. |
| 7,591,910 | B2 | | 9/2009 | Xu et al. |
| 7,753,986 | B2 | | 7/2010 | Fishman |
| 8,034,200 | B2 | | 10/2011 | Fleury et al. |
| 8,221,561 | B2 | | 7/2012 | Gong et al. |
| 8,308,877 | B2 | | 11/2012 | Gong et al. |
| 8,333,850 | B2 | | 12/2012 | Gong et al. |
| 2003/0079813 | A1 | * | 5/2003 | Zhang ..... C22C 45/10 148/561 |
| 2008/0190521 | A1 | | 8/2008 | Loffler et al. |
| 2009/0139612 | A1 | | 6/2009 | Lu et al. |
| 2009/0202386 | A1 | | 8/2009 | Yi et al. |
| 2011/0097237 | A1 | | 4/2011 | Gong et al. |
| 2011/0100514 | A1 | | 5/2011 | Liu et al. |
| 2011/0163509 | A1 | | 7/2011 | Pham et al. |
| 2011/0308671 | A1 | * | 12/2011 | Gong ..... C22C 1/002 148/403 |
| 2012/0073706 | A1 | | 3/2012 | Gong et al. |
| 2012/0222780 | A1 | | 9/2012 | Yuan et al. |
| 2012/0222785 | A1 | | 9/2012 | Li et al. |
| 2012/0298264 | A1 | | 11/2012 | Yi et al. |
| 2012/0305142 | A1 | | 12/2012 | Jaworski et al. |

OTHER PUBLICATIONS

Bhowmick, Ranadeep et al. "Synthesis of bulk metallic glass composites using high oxygen containing Zr sponge," J. Mater. Sci., vol. 42 (2007) 9359-9365.

Cheng, Jia-Lin et al. "Innovative approach to the design of low-cost Zr-based BMG composites with good glass formation," Scientific Reports, 3:2097 (Jun. 28, 2013) 1-5.

Zirconium and Zirconium Alloys, What-When-How in Depth Tutorials and Information, The-Crankshaft Publishing, 5 pages, retrieved from the Internet on Sep. 24, 2015 at http://what-when-how.com/materialsparts-and-finishes/zirconium-and-alloys/.

* cited by examiner

METHODS FOR MAKING ZIRCONIUM BASED ALLOYS AND BULK METALLIC GLASSES

This application claims the benefit of U.S. Provisional Patent Application No. 62/058,648 filed Oct. 1, 2014, the entire contents of which are incorporated herein by reference.

BACKGROUND

Field of the Disclosure

The present disclosure relates to metallic alloys, and more particularly to the production of zirconium based alloy feedstock.

Background Information

Certain alloys comprising zirconium (Zr) may require high purity of the alloy chemistry to achieve desired properties. For example, bulk metallic glass (BMG) alloys that incorporate Zr, e.g., those that incorporate little or no beryllium (Be), may be formed using high purity Zr crystal bar feedstock. Other high performance crystalline alloys that include Zr may also rely upon high purity Zr crystal bar feedstock for their production. High purity alloys that comprise Zr may be expensive to produce due to, among other things, the expense of the high purity Zr crystal bar feedstock.

BMGs are a family of materials that, when cooled at rates generally less than 100° C./s, form an amorphous (or non-crystalline) microstructure with thicknesses in the range of 0.1 to 10 mm or greater. BMGs may have unique and novel properties given their lack of long-range order and absence of crystalline structure. BMG alloys may have exceptional strength, high elasticity, limited plasticity, good corrosion and wear resistance, and high hardness relative to their crystalline counterparts. From a processing perspective, the alloys also offer unique possibilities. BMG alloys may have melting temperatures far below their constituent elements, allowing for permanent mold casting processes and other processing such as thermoplastic forming, which are not possible with many conventional alloy systems.

The present inventors have observed a need for improved approaches for producing Zr based alloys, including BMGs, at lower cost. Exemplary approaches described herein may address such needs.

SUMMARY

These and other features, aspects, and advantages of the present disclosure will become better understood with regard to the following description, appended claims, and accompanying drawings.

In one example, a method of preparing a Zr-based metallic alloy comprises heating Zr sponge comprising Zr and multiple contaminants in a sponge structure in a processing chamber with an electron-beam-heating apparatus or an arc-melting apparatus under a desired pressure condition to release volatile contaminants from the Zr sponge; introducing a purge gas into the processing chamber and permitting the purge gas to intermingle with at least some of the released volatile contaminants; evacuating the processing chamber to extract at least some of the purge gas and released volatile contaminants; repeating said heating of the Zr sponge, said introducing a purge gas, and said evacuating the processing chamber release and evacuate additional volatile contaminants from the Zr sponge to provide a processed Zr sponge with enhanced purity; melting the processed Zr sponge with multiple other alloy constituents to provide a Zr-based metallic alloy.

In an example, the Zr-based metallic alloy may comprise Zr, Ti, Cu, Ni, and Be. In an example, the Zr-based metallic alloy may comprise Zr, Ti, Cu, Ni, and Al. In an example, the Zr-based metallic alloy may comprise Zr, Cu, Ni, Al, and Nb.

In an example, the method may comprise cooling the Zr-based metallic alloy so that it solidifies as a bulk metallic glass.

In an example, the Zr-based metallic alloy may be substantially amorphous in structure.

In an example, the volatile contaminants may comprise Mg and Cl.

In an example, the method may comprise gettering oxygen with a getter during the heating the Zr sponge. The getter may comprise a Ti getter.

In an example, a mass of the Zr sponge heated in a given heating operation may be in the range of 5 kg to 50 kg.

In an example, the purge gas comprises an inert gas, such as argon, helium or nitrogen, or combinations thereof.

In an example, the desired pressure condition may comprise a vacuum condition. The vacuum condition may be provided with the addition of an inert gas into the processing chamber.

In an example, the heating of the Zr sponge may comprise melting the Zr sponge.

In an example, the heating of the Zr sponge under a desired pressure condition may comprise heating under a vacuum condition, wherein the method may further comprise additionally heating the Zr sponge material under an overpressure condition in the presence of an inert gas.

BRIEF DESCRIPTION OF THE FIGURES

These and other features, aspects, and advantages of the present disclosure will become better understood with regard to the following description, appended claims, and accompanying drawings.

DETAILED DESCRIPTION OF EXEMPLARY EMBODIMENTS

Figure 1:
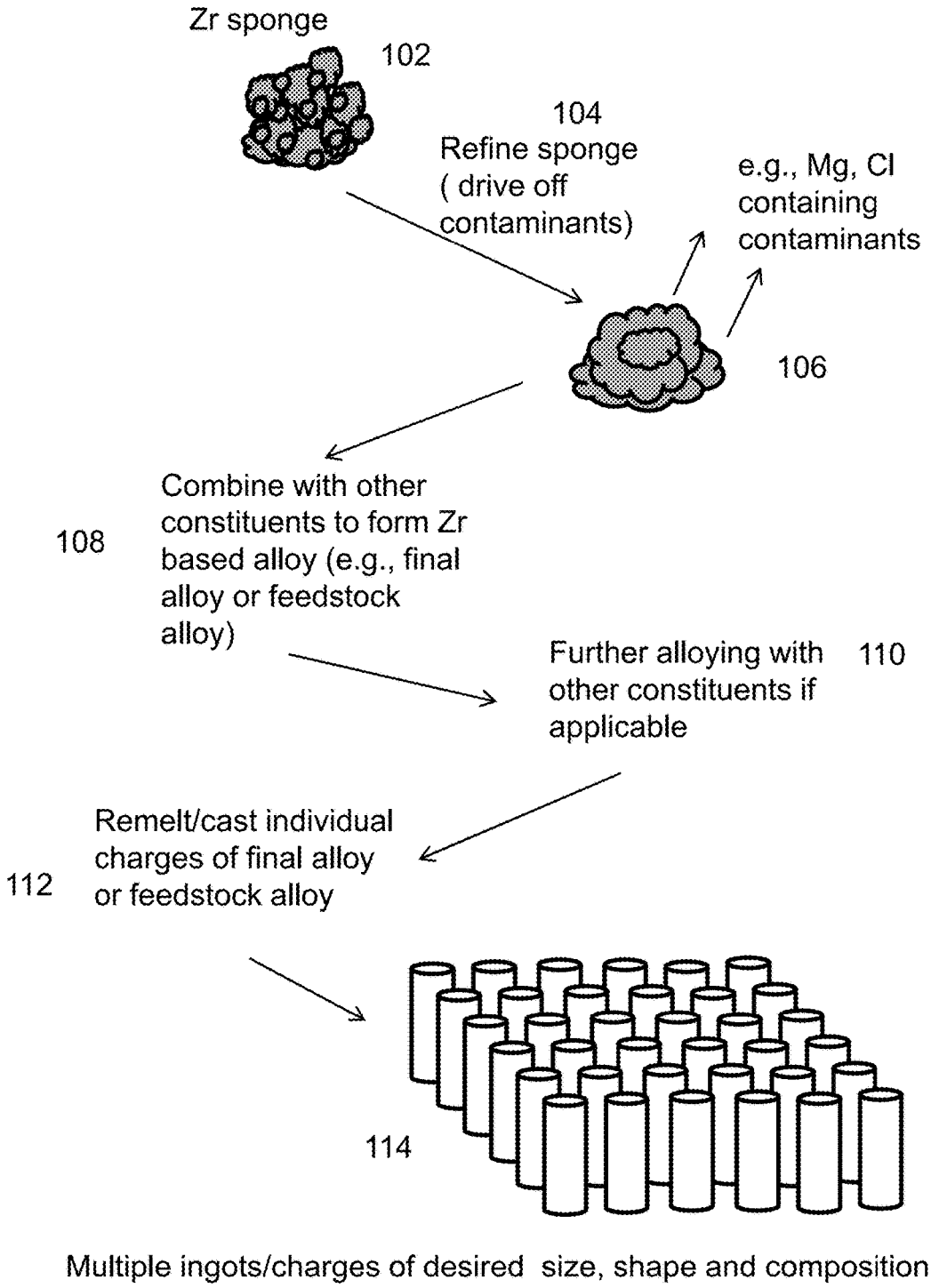
FIG. 1 illustrates an overview of an exemplary approach for preparing Zr based metallic alloy such as a BMG.

BMG alloys generally contain combinations of three or more different elements, and some of the best BMG alloy forming systems contain four or five or more elements. Often, the elements are quite different from one another (early or late transition metal, metalloid, etc.) and form deep eutectic systems. This suggests that the thermodynamically disparate elements are more stable as a molten solution than in a solid-state. It is believed that the elements in such molten solutions encounter difficulty arranging into a crystal structure during solidification, and this allows the alloy to remain as an undercooled liquid and eventually a metallic glass. The best glass forming alloys generally have the slowest critical cooling rates, and this allows for a wider processing window for robust processing and production. Many good glass forming alloys (those with slow critical cooling rates) contain the metallic element Be, or metalloids such as P or B. Other good glass forming alloys may incorporate Zr, such as: Zr—Ti—Cu—Ni—Be BMGs, such as described in U.S. Pat. No. 5,288,344, Zr—Cu—Al—Ni BMGs and Zr—Cu—Al—Ni—Nb BMGs, such as described in U.S. Pat. Nos. 6,592,689 and 7,070,665, Zr—(Ni, Cu, Fe, Co, Mn)—Al BMGs, such as described in U.S. Pat. No. 5,032,196, and Zr-based alloys described in U.S. Patent Application Publication No. 2011/0163509. Other Zr based BMG alloys include those disclosed in the following patent documents: U.S. Pat. Nos. 8,333,850, 8,308,877, 8,221,561, 8,034,200, 7,591,910, 7,368,023, 7,300,529, 7,153,376, 7,070,665, 6,896,750, 6,805,758, 6,692,590, 6,682,611, 6,592,689, 6,521,058, 6,231,697, 5,735,975; U.S. Patent Application Publication Nos. 20120305142, 20120298264, 2012022278, 20120073706, 20110308671, 20110100514, 20110097237, 20090202386, 20090139612, 20080190521; and International Patent Application Publication No. WO2011159596. The entire contents of each of the foregoing patent documents listed in this paragraph are incorporated herein by reference in their entirety.

Besides the unique combinations of alloying elements, BMG alloys may require tight alloy composition, contaminant, and inclusion control to maintain high glass forming ability. Oxygen, carbon, and nitrogen are usually unfavorable for glass forming ability. It is believed that these elements may enhance nucleation of a solid phase during cooling from the liquid state to below the glass transition temperature. Other elements that promote formation of stable solid phases (e.g., Fe contaminants in Zr-based VITRELOY® alloys) are also detrimental. Production of alloys that achieve the desired chemistry while avoiding contaminants is a manufacturing challenge.

The present disclosure relates to approaches for preparing metallic alloys that contain Zr as a constituent, including BMG alloys, crystalline alloys and feedstock alloys (precursor alloys for making other alloys). High purity Zr feedstock is generally very expensive because it is produced by a slow process and limited to a small number of global suppliers. Prices of high purity Zr feedstock can be volatile because of the limited number of producers and consumers. Non-Be or low-Be containing Zr-based BMG alloys may require high purity input materials; generally with oxygen levels of less than 1000 ppm; and often less than 500 ppm. There are few zirconium metal sources which have sufficiently high purity (for example; low concentrations of Fe; Hf; and Sn) for making sufficient quality bulk metallic glass alloy and feedstock alloy. One source of Zr is Zr sponge, which is readily available and can have low levels of metallic impurities and oxygen less than <1000 ppm. However; Zr sponge is made with the Kroll process involving reduction of $ZrCl_4$ using Mg, leaving some residual Mg and $MgCl_2$ in the sponge. These volatile compounds are detrimental to formation of BMG alloys and other Zr based alloys that require high purity. The present disclosure addresses, among other things, the processing and use of Zr sponge to yield Zr metal of sufficiently high purity for use in producing Zr alloys and feedstock that require high purity.

In some examples of preparing alloys using Zr sponge, an intermediate processing step (refining step) may be carried out on Zr sponge, e.g., arc melting or electron beam melting, to drive off volatile Mg and Cl containing compounds present in the Zr sponge. The cost of the Zr sponge with such added processing steps may be lower than the cost of comparable high purity Zr crystal bar. Furthermore, in some examples, during the refining step, it is possible to add other BMG alloying elements to create a master feedstock alloy (e.g. Zr—Cu; Zr—Cu—Ni; Zr—Ti; etc.) for use in preparing the ultimate desired Zr alloy. In some examples, when producing an alloy such as a BMG alloy, the refined sponge; or the refined sponge master alloy, may be combined with another Zr source such as crystal bar to further decrease oxygen levels in the resulting alloy, e.g., BMG alloy.

FIG. 1 is a schematic illustration of an overview of an exemplary approach for forming a Zr-based metallic alloy, e.g., a Zr-based BMG of suitable composition such as disclosed herein. Zr sponge 102 of suitable size and amount is arranged and then refined (104) to drive off contaminants such as Mg and Cl containing contaminants associated with Zr sponge. This initial charge of Zr sponge may be of any desired size, e.g., 3 kg, 5 kg, 10 kg, 25 kg, 50 kg, etc, and may be in any suitable form, e.g., small pieces, large pieces, etc. The refining can be done by heating the Zr sponge with an arc melter apparatus or an electron-beam apparatus in a vacuum chamber under vacuum as disclosed elsewhere herein so as to cause the contaminants to be driven off and pumped out of the vacuum chamber or condensed on the cold surfaces of the melting vacuum chamber. The Zr sponge may or may not be heated to a molten state during the refining step. The refined Zr (106) may then be combined (108) with other alloy constituents to form either the final Zr alloy, e.g., by inductive melting such as in a crucible, arc melting, electron-beam melting, etc. Further alloying (110) may be carried out if applicable in the same or similar manner, e.g., to provide a final alloy or another feedstock alloy. The resulting alloy may then be remelted and/or cast (112) if desired to yield many ingots of alloy (114), which may be referred to as individual die cast charges or simply individual charges, of a desired smaller size, e.g., 25 grams, 50 grams, 100 grams, 500 grams, 1 kg, 5 kg, etc., for further processing as may be applicable. Cooling in the final step may be carried out at a sufficiently fast rate so as to cause the molten alloy to form an amorphous structure.

Further exemplary details will now be described further with reference to FIGS. 2-4.

Figure 2A:
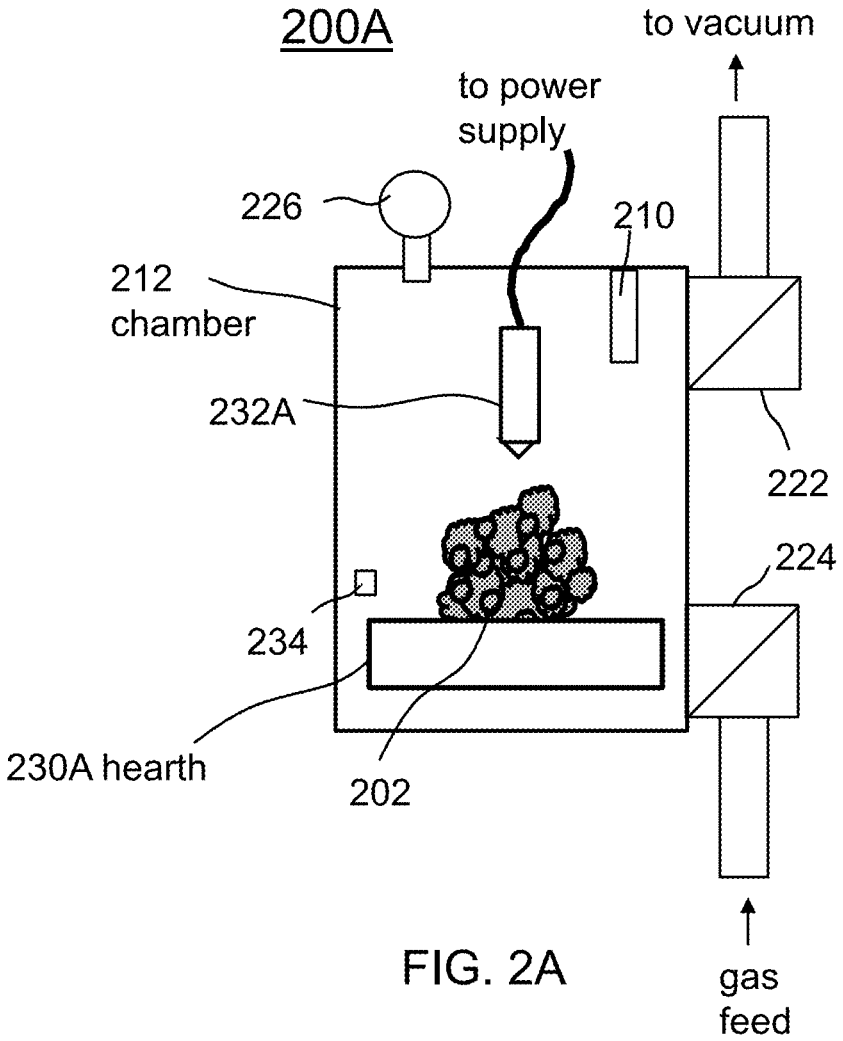
FIGS. 2A and 2B illustrate an exemplary apparatuses and approaches for refining Zr sponge material for preparing a metallic alloy such as a BMG.

FIG. 2A shows an exemplary apparatus 200A and approach for refining a Zr metallic alloy, e.g., such as alloys of Zr—Ti—Cu—Ni—Be of various compositions, alloys of Zr—Ti—Cu—Ni—Al of various compositions, and alloys of Zr—Cu—Ni—Al—Nb of various compositions, and Zr-based alloys comprising other or additional constituents, such as BMG alloys. The heating apparatus 200A that may be capable of providing both a vacuum environment as well as an overpressure environment. In this example, the apparatus 200A comprises a vacuum chamber 212, a hearth (e.g., water cooled) 230A with an arc-melting electrode 232A coupled to a suitable power supply for supplying current to heat and/or melt the Zr sponge charge 202 to provide refining to enhance the purity of the Zr. A vacuum valve 222 connected to a port of the vacuum chamber 212 is connected to a vacuum system to evacuate the chamber 212 and maintain a desired level of pressure/vacuum in the chamber 212. A valve 224 is connected to a port on the vacuum chamber 212 to permit gas, e.g., inert gas such as argon, helium, nitrogen, etc., to be fed into the chamber 212 to maintain a desired gaseous environment in the chamber 212 at a desired pressure, including an overpressure if desired, as well as to purge the chamber of contaminants through alternating evacuation and back filling with inert gas. One or more pressure sensors 226 may be provided for measuring the pressure in the vacuum chamber 212. Any suitable combination of gas flow controllers, pressure sensors, vacuum pumps and associated vacuum plumbing may be utilized to control the vacuum/pressure conditions and gaseous environment of the vacuum chamber 212, e.g., in the range of one bar to several bars or more, (e.g., about 2, 3, 4 or 5 bars, 6-10 bars, or more) wherein one bar is atmospheric pressure (760 Torr) to sub-ambient pressures less than atmospheric pressure (e.g., a few hundred Torr to $10^{-6}$ Torr), including low vacuums (e.g., $10^{-2}$-$10^{-6}$ Torr, or below, for instance). One or more temperature sensors 234 (e.g., optical pyrometer) for measuring the temperature of the Zr charge may be provided. A titanium getter 210 may also be included to absorb oxygen or other contaminants that be liberated during the refining step.

Power is applied from the arc melter electrode 232A to the Zr sponge 202 by controlling power from an arc-melter power supply (e.g., a conventional welding power supply) to provide sufficient heating of the Zr sponge to drive contaminating compounds from the Zr sponge, e.g., volatile Mg and Cl compounds. The level of the applied power and duration of the refining step will depend upon the size of the Zr sponge charge being refined and may be determined by straightforward testing trials, which may include chemical analysis by conventional methods to verify the sufficiency of the purity of the processed Zr following the refining step. If it is determined that any contaminants exceed desired levels, further refinement may be carried out, and/or the resulting Zr may be additionally remelted with an amount of high purity Zr crystal bar to dilute the concentration of contaminants in the refined Zr metal. In some examples, the Zr sponge may be heated to a fully molten state. A titanium getter 210 may also be included to absorb oxygen or other contaminants that be liberated during the refining step. In some examples, the refined Zr metal may be directly cast from the molten state into a Zr ingot of a particular shape using a mold at another region of the water cooled hearth.

Figure 2B:
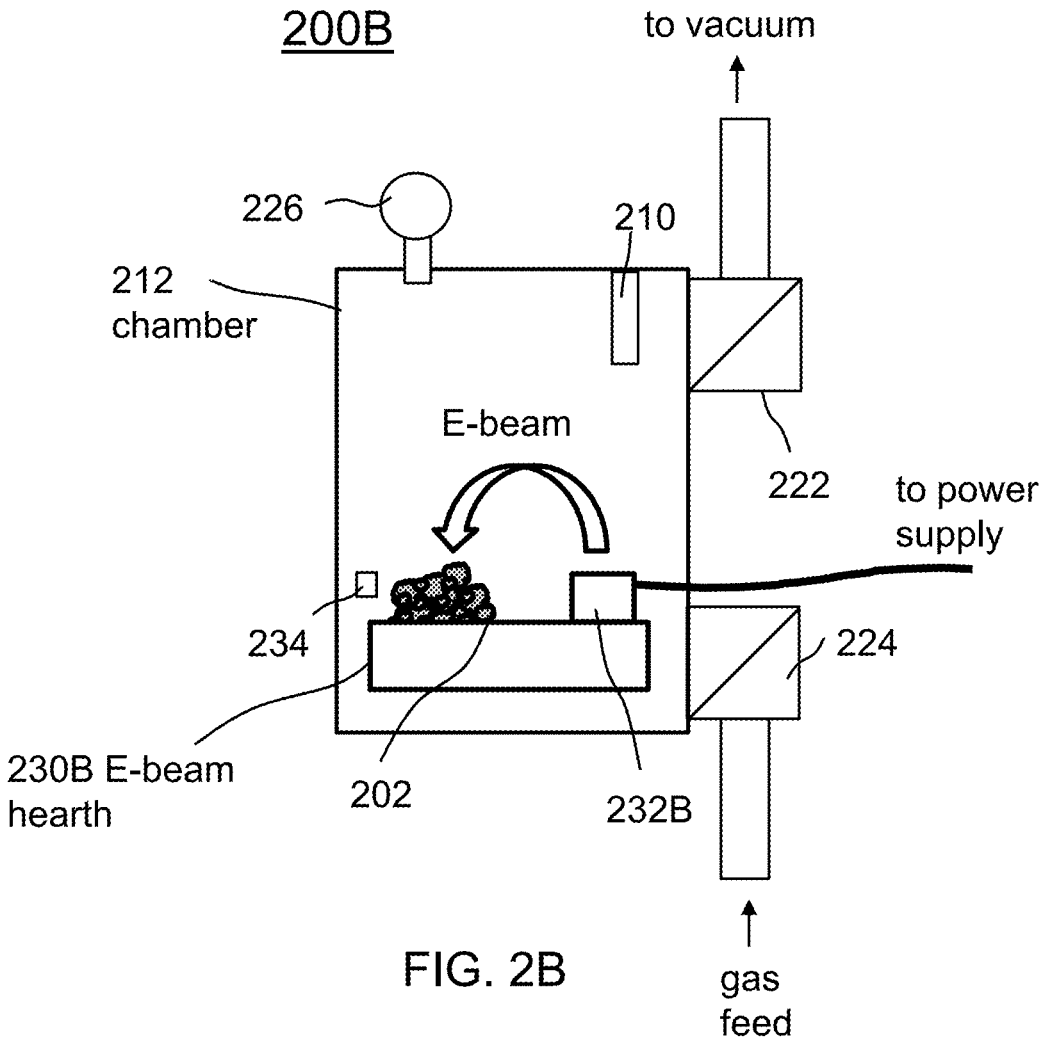

In another example, FIG. 2B shows an exemplary apparatus 200B and approach for refining a Zr metallic alloy, e.g., such as alloys of Zr—Ti—Cu—Ni—Be of various compositions, alloys of Zr—Ti—Cu—Ni—Al of various compositions, and alloys of Zr—Cu—Ni—Al—Nb of various compositions, and Zr-based alloys comprising other or additional constituents, such as BMG alloys. The heating apparatus 200B may be capable of providing both a vacuum environment as well as an overpressure environment. In this example, the apparatus 200B comprises a vacuum chamber 212, an electron-beam hearth (e.g., water cooled) 230B with an electron beam source 232 coupled to a suitable power supply for powering an electron beam to heat and/or melt the Zr sponge charge 202. A vacuum valve 222 connected to a port of the vacuum chamber 212 is connected to a vacuum system to evacuate the chamber 212 and maintain a desired level of vacuum in the chamber 212. A valve 224 is connected to a port on the vacuum chamber 212 to permit gas, e.g., inert gas such as argon, helium, nitrogen, etc., to be fed into the chamber 212 to provide a source of gas, if desired, e.g., to purge the chamber of contaminants through alternating evacuation and back filling with inert gas. One or more pressure sensors 226 may be provided for measuring the pressure in the vacuum chamber 212. Any suitable combination of gas flow controllers, pressure sensors, vacuum pumps and associated vacuum plumbing may be utilized to control the vacuum/pressure conditions and gaseous environment of the vacuum chamber 212, e.g., in the range of one bar to several bars or more, (e.g., about 2, 3, 4 or 5 bars, 6-10 bars, or more) wherein one bar is atmospheric pressure (760 Torr) to sub-ambient pressures less than atmospheric pressure (e.g., a few hundred Torr to $10^{-6}$ Torr), including low vacuums (e.g., $10^{-2}$-$10^{-6}$ Torr, or below, for instance). One or more temperature sensors 234 (e.g., optical pyrometer) for measuring the temperature of the Zr charge may be provided. A titanium getter 210 may also be included to absorb oxygen or other contaminants that be liberated during the refining step.

Power is applied from the electron beam source 232B to the Zr sponge 202 by controlling power from an electron-beam power supply to provide sufficient heating of the Zr sponge to drive contaminating compounds from the Zr sponge, e.g., volatile Mg and Cl compounds. The level of the applied power and duration of the refining step will depend upon the size of the Zr sponge charge being refined and may be determined by straightforward testing trials, which may include chemical analysis to verify the sufficiency of the purity of the processed Zr following the refining step. If it is determined that any contaminants exceed desired levels, further refinement may be carried out, and/or the resulting Zr may be additionally remelted with an amount of high purity Zr crystal bar to dilute the concentration of contaminants in the refined Zr metal. In some examples, the Zr sponge may be heated to a fully molten state. In some examples, the refined Zr metal may be directly cast from the molten state into a Zr ingot of a particular shape using a mold at another region of the water cooled hearth.

Figure 3:
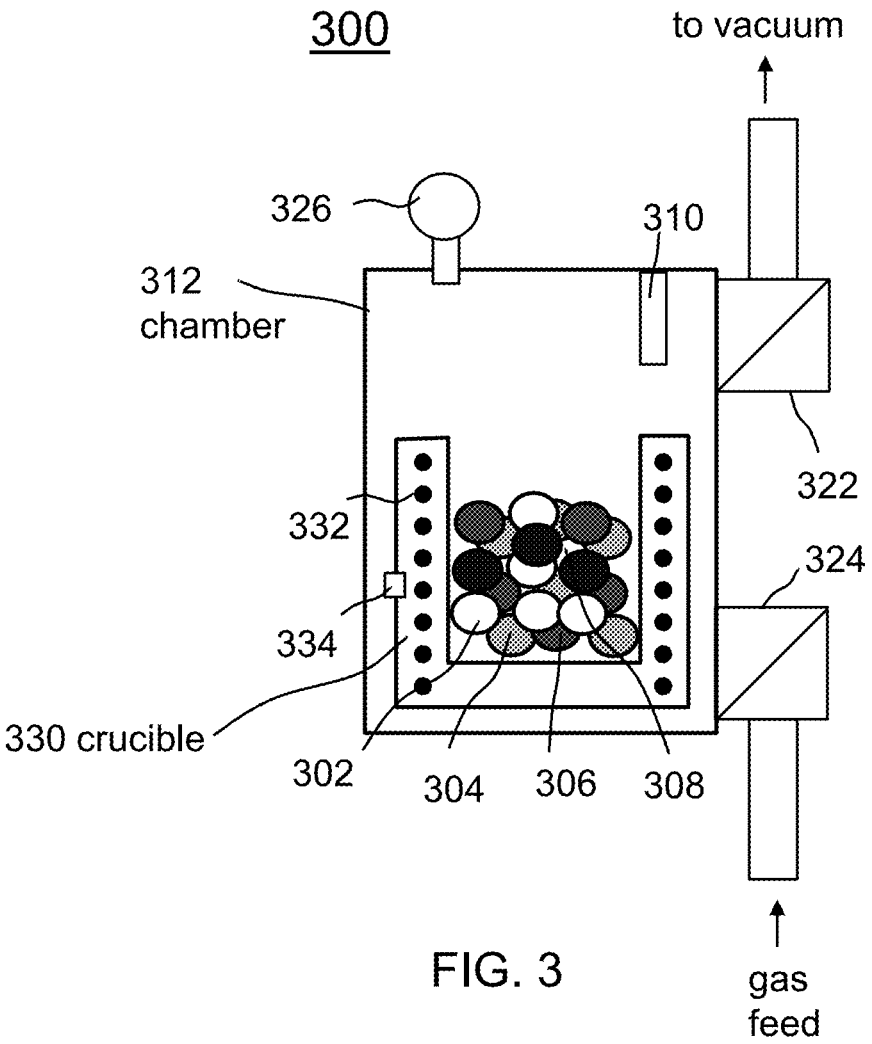
FIG. 3 illustrates an exemplary apparatus and approach for preparing a Zr-based metallic alloy such as a BMG.
Figure 4:
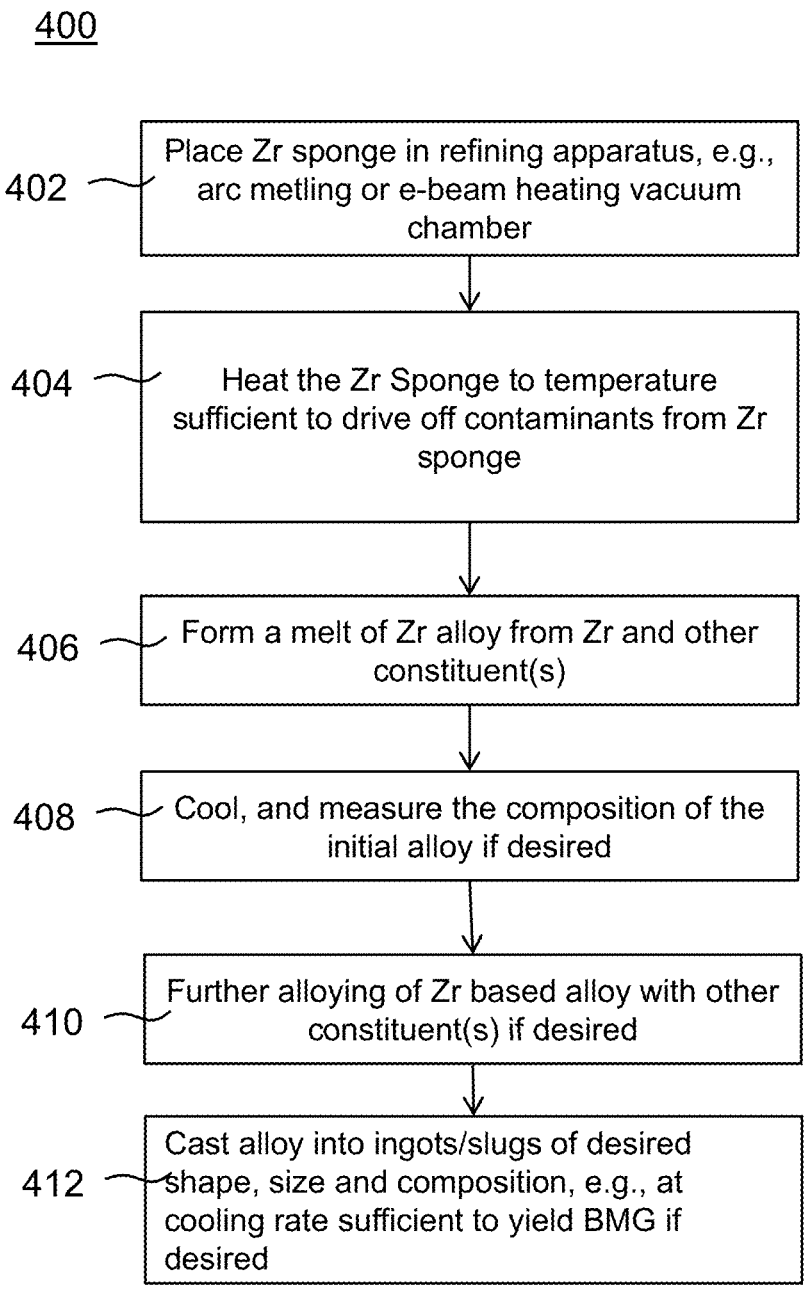
FIG. 4 illustrates a flow diagram of an exemplary approach for preparing a Zr based metallic alloy such as a BMG.

FIG. 3 illustrates an exemplary system and approach for making a Zr-based alloy using refined Zr that has been produced from Zr sponge as described above. Reference will also be made to the flow diagram of FIG. 4. As shown in step 402 of FIG. Zr sponge is placed in a refining apparatus, e.g., an arc melting apparatus or electron-beam heating apparatus and is heated (step 404) to temperature and for a duration sufficient to drive off contaminants, e.g., Mg and Cl containing contaminants, such as described above. As shown in FIG. 3 and as noted at step 406 of FIG. 4, multiple constituents including the refined Zr 202 and other constituents 304, 306, 308, are placed into a container, e.g., crucible 330, and heated to form a molten alloy. Such constituents may include, for instance, Ti, Ni, Be, Al, Nb and Cu in any suitable combination, or other constituents for alloys such as disclosed herein or in references incorporated herein by reference. The crucible 330 may be heated by an induction heating coil 332, or by any other suitable means of heating, to promote alloying and melting of the constituents. For instance, an arc melting apparatus such as illustrated in FIG. 2A or an electron beam apparatus such as illustrated in FIG. 2B could be used to form the molten alloy.

A vacuum valve 322 connected to a port of the vacuum chamber 312 is connected to a vacuum system to evacuate the chamber 312 and maintain a desired level of vacuum in the chamber 312. A valve 324 is connected to a port on the vacuum chamber 312 to permit gas, e.g., inert gas such as argon, helium, nitrogen, etc., to be fed into the chamber 212 to provide a source of gas, if desired, e.g., to purge the chamber of contaminants through alternating evacuation and back filling with inert gas. One or more pressure sensors 326 may be provided for measuring the pressure in the vacuum chamber 312. Any suitable combination of gas flow controllers, pressure sensors, vacuum pumps and associated vacuum plumbing may be utilized to control the vacuum/pressure conditions and gaseous environment of the vacuum chamber 312, e.g., in the range of one bar to several bars or more, (e.g., about 2, 3, 4 or 5 bars, 6-10 bars, or more) wherein one bar is atmospheric pressure (760 Torr) to sub-ambient pressures less than atmospheric pressure (e.g., a few hundred Torr to $10^{-6}$ Torr), including low vacuums (e.g., $10^{-2}$-$10^{-6}$ Torr, or below, for instance). One or more temperature sensors 334 (e.g., thermocouple or optical pyrometer, etc.) for measuring the temperature of the crucible 330 or alloy being melted may be provided. A Ti getter 310 may also be included to absorb oxygen or other ambient contaminants during the melting to prevent them from contaminating the alloy under formation. In one example, a molten pre-alloy, e.g., of Zr—Cu or some other alloy may be formed, and then that pre alloy may be further alloyed with other constituents in the desired amounts to provide the desired composition for the alloy. The heating and melting may be carried out in an inert atmosphere at a pressure of less than, equal to, or greater than 1 bar, e.g., several bars or more of Argon or other inert gas.

Thereafter, the melt may be cooled (step 408), e.g., by pouring the melt into a desired mold, thereby forming a Zr based metallic alloy, which may be an initial alloy, e.g., feedstock for another alloy, or a final alloy. The composition of the initial alloy may be measured if desired. A determination can be made on what, if any, additional constituent(s) should be added and in what amount(s) to bring the alloy to the desired composition.

At step 410 further alloying may be carried out with other constituents, if desired, e.g., to obtain the desired alloy composition. The Zr-based alloy may then be cast (step 412) into individual ingots (also called slugs or charges) of the desired size and desired composition. The result is many ingots or slugs of desired size, shape and composition. This step can be carried out in a different chamber/furnace system than that used for the prior heating/melting, or in the same chamber/furnace system used for the prior heating/melting but with a different crucible/heater arrangement, for instance. For example, this step can be carried out, if desired, in hot isostatic press (HIP) apparatus, or pressurized furnace apparatus.

The cooling during the casting step 412 can be done at any desired rate. For instance, the cooling could be carried out slowly, such that the resulting ingots or slugs have a crystalline or partially crystalline structure, in which case they may be used as charges for later remelting and casting at a sufficient cooling rate into BMG materials or parts. Alternatively, the cooling at step 412 may be carried out sufficiently quickly by suitable quenching, e.g., water quenching, so that the resulting ingots or slugs will already have a BMG structure, i.e., are cooled directly to an amorphous state. These ingots or slugs can then be used for further molding processes into BMG parts.

Alternatively, the casting at step 412 can be carried out in a vacuum controlled counter gravity casting apparatus, such that the melt can be cast into any suitable counter-gravity-casting mold with less turbulence and potentially greater control of the casting process. In this case, the cooling can be carried out slowly or quickly such as described above to obtain resulting ingots of either crystalline or BMG structure. In any of these options, the choice of suitable temperatures, heating times and pressures can be determined from experimental testing and/or modeling.

The above described approaches may have benefits over conventional approaches for forming BMG alloys containing Zr. For example, the approaches described herein permit Zr sponge to be utilized for alloying, following a refinement process to enhance its purity, in place of high purity Zr crystal bar. Such Zr-based alloys may be made less expensively and with greater options for sources for the starting Zr material.

While the present invention has been described in terms of exemplary embodiments, it will be understood by those skilled in the art that various modifications can be made thereto without departing from the scope of the invention as set forth in the claims.

What is claimed is:

1. A method of preparing a Zr-based metallic alloy, comprising:

heating Zr having a sponge structure under a vacuum condition in a processing chamber with an electron-beam-heating apparatus or an arc-melting apparatus to release volatile contaminants from the Zr;

introducing a purge gas into the processing chamber and permitting the purge gas to intermingle with at least some of the released volatile contaminants;

evacuating the processing chamber to extract at least some of the purge gas and released volatile contaminants;

additionally heating the Zr under an overpressure condition in the presence of an inert gas after said heating Zr having a sponge structure under a vacuum condition;

conducting another heating of the Zr to release additional volatile contaminants from the Zr, conducting another introduction of purge gas into the processing chamber, and conducting another evacuation of the processing chamber to provide processed Zr with enhanced purity; and melting the processed Zr with multiple other alloy constituents to provide a Zr-based metallic alloy.

2. The method of claim 1, wherein the Zr-based metallic alloy comprises Zr, Ti, Cu, Ni, and Be.

3. The method of claim 1, wherein the Zr-based metallic alloy comprises Zr, Ti, Cu, Ni, and Al.

4. The method of claim 1, wherein the Zr-based metallic alloy comprises Zr, Cu, Ni, Al, and Nb.

5. The method of claim 1, comprising cooling the Zr-based metallic alloy so that it solidifies as a bulk metallic glass.

6. The method claim 1, wherein the Zr-based metallic alloy is substantially amorphous in structure.

7. The method of claim 1, wherein the volatile contaminants comprise Mg and Cl.

8. The method of claim 1, comprising gettering oxygen in the processing chamber with a getter in the presence of the Zr.

9. The method of claim 8 wherein the getter comprises a Ti getter.

10. The method of claim 1, wherein a mass of the Zr heated in a given heating operation is in the range of 5 kg to 50 kg.

11. The method of claim 1, wherein the purge gas comprises an inert gas.

12. The method of claim 1, wherein the vacuum condition is provided with the addition of an inert gas into the processing chamber.

13. The method of claim 1, wherein the heating of the Zr comprises melting the Zr.

14. A method of preparing a Zr-based metallic alloy, comprising:

heating Zr having a sponge structure under a vacuum condition in a processing chamber to release contaminants from the Zr;

purging at least some of the released contaminants from the processing chamber with a purge gas;

evacuating the processing chamber after said purging;

additionally heating the Zr under an overpressure condition in the presence of an inert gas after said heating Zr having a sponge structure under a vacuum condition;

further heating the Zr to release additional contaminants from the Zr, and further purging the processing chamber after said further heating to provide processed Zr with enhanced purity; and melting the processed Zr with multiple other alloy constituents to provide a Zr-based metallic alloy.

15. The method of claim 14, wherein the Zr-based metallic alloy comprises Zr, Ti, Cu, Ni, and Be.

16. The method of claim 14, wherein the Zr-based metallic alloy comprises Zr, Ti, Cu, Ni, and Al.

17. The method of claim 14, wherein the Zr-based metallic alloy comprises Zr, Cu, Ni, Al, and Nb.

18. The method of claim 14, comprising cooling the Zr-based metallic alloy so that it solidifies as a bulk metallic glass.

19. The method of claim 14, wherein the Zr-based metallic alloy is substantially amorphous in structure.

20. The method of claim 14, comprising gettering oxygen with a getter in the processing chamber in the presence of the Zr.

21. The method of claim 14, wherein a mass of the Zr heated in a given heating operation is in the range of 5 kg to 50 kg.

22. The method of claim 14, wherein the heating of the Zr comprises melting the Zr.

23. The method of claim 14, wherein the vacuum condition is provided with the addition of an inert gas into the processing chamber.

* * * * *